US007955197B2

(12) United States Patent
Roudybush

(10) Patent No.: US 7,955,197 B2
(45) Date of Patent: Jun. 7, 2011

(54) PITCHING AND THROWING TRAINING MECHANISM

(76) Inventor: Kenneth A. Roudybush, Amity, OR (US)

( * ) Notice: Subject to any disclaimer, the term of this patent is extended or adjusted under 35 U.S.C. 154(b) by 99 days.

(21) Appl. No.: 12/356,466

(22) Filed: Jan. 20, 2009

(65) Prior Publication Data

US 2009/0203471 A1 Aug. 13, 2009

Related U.S. Application Data

(60) Provisional application No. 61/027,389, filed on Feb. 8, 2008.

(51) Int. Cl.
*A63B 69/00* (2006.01)

(52) U.S. Cl. ..... 473/458; 473/424

(58) Field of Classification Search ..... 473/422–425, 473/450, 458, 464, 451; 434/247; 482/122, 482/126, 131
See application file for complete search history.

(56) References Cited

U.S. PATENT DOCUMENTS

| | | | | |
|---|---|---|---|---|
| 4,220,333 | A * | 9/1980 | Mercer | 473/60 |
| 4,477,075 | A * | 10/1984 | Outman | 473/458 |
| 4,834,375 | A * | 5/1989 | Elstein et al. | 473/417 |
| 4,846,471 | A * | 7/1989 | Haysom | 473/451 |
| 5,092,588 | A | 3/1992 | Deluca | |
| 5,250,016 | A * | 10/1993 | Higgins | 482/121 |
| 5,423,730 | A * | 6/1995 | Hirsch | 482/92 |
| 6,007,500 | A * | 12/1999 | Quintinskie, Jr. | 601/5 |
| 6,884,187 | B2 | 4/2005 | Cataldi, Jr. et al. | |
| 7,374,502 | B2 * | 5/2008 | Comello, Jr. | 473/458 |
| 7,699,724 | B1 * | 4/2010 | Derisse | 473/451 |
| 2003/0220173 | A1 * | 11/2003 | Parker | 482/44 |
| 2007/0105663 | A1 | 5/2007 | Farnsworth et al. | |

FOREIGN PATENT DOCUMENTS

| | | |
|---|---|---|
| JP | 394265 | 9/1991 |
| JP | 734867 | 6/1995 |
| JP | 3121709 | 5/2006 |
| KR | 100676083 | 1/2007 |
| KR | 6884187 | 2/2007 |

OTHER PUBLICATIONS

International Search Report & Written Opinion for International Application No. PCT/US2009/033481.
International Preliminary Report on Patentability from PCT/US2009/033481, mailed Aug. 19, 2010, 6 pages.

* cited by examiner

*Primary Examiner* — Mitra Aryanpour
(74) *Attorney, Agent, or Firm* — Blakely, Sokoloff, Taylor & Zafman

(57) ABSTRACT

A training device provides interactive feedback to encourage proper snapping action in an arcing motion for sports training. The feedback can include an audible response that is variable, corresponding to pressure or force applied to the training device due to centripetal acceleration. The training can be overhand throwing or underhand pitching, or other swinging sports motions. The size and weight of the training device, as well as the audio feedback, can reinforce proper form and build muscle memory for correct movements.

14 Claims, 5 Drawing Sheets

PITCHING AND THROWING TRAINING MECHANISM

This application claims priority under 35 U.S.C. §119 from U.S. Provisional Application Ser. No. 60/027,389, filed Feb. 8, 2008.

FIELD

Embodiments of the invention relate to sports training, and more particularly devices and systems for pitching and throwing training.

BACKGROUND

The theory of sports training is to build correct muscle memory during training that will translate into correct muscle movement during an athletic event. Correct muscle movement during an athletic event is expected to produce a desired performance during the athletic event. Incorrect form during training builds incorrect muscle memory and will result in poorer performance during an athletic event.

Sports training for pitching, throwing, and hitting consists of repetitive cycles of pitching, throwing, and hitting. Training must be observed and corrected as needed to insure that the correct muscle memory is being created. Current training methods today generally require an outside observer (a trainer or coach) to observe and correct form during training to produce desired muscle memory. Training sessions need to be long to insure that muscle memory is being developed by consistency, which can only be developed by a large number of correctly performed repetitions.

Very few training devices exist to aid in the development of correct muscle memory. Most existing training devices are geared toward building muscle mass. No current training devices are self correcting, forcing the building of correct muscle memory. Some existing devices are large, heavy and bulky and do not lend themselves to portability. Most existing training devices require an extensive amount of time to train because rapid repetitive motion is not allowed. A coach is necessary to insure proper and correct muscle memory is being built. Most existing technologies cannot be performed without the aid of one or more additional individuals which requires an individual to schedule training around other people's schedules.

Even current devices that can be used to train muscle memory have drawbacks. Most still require the assistance of another person (a coach or trainer) to make sure the person performing the training is using proper form. Even with a coach, consistency may be difficult to achieve, which reduces the effectiveness of the training. Another problem with training devices is that the use of the training devices will frequently just feel like work. Only the most motivated individuals are able to gain the full benefits of the devices. Repetitive performance is generally difficult to maintain without adequate feedback. Without a trainer constantly monitoring and providing the feedback, even the most effective training devices may go unused.

BRIEF DESCRIPTION OF THE DRAWINGS

The following description includes discussion of figures having illustrations given by way of example of implementations of embodiments of the invention. The drawings should be understood by way of example, and not by way of limitation. As used herein, references to one or more "embodiments" are to be understood as describing a particular feature, structure, or characteristic included in at least one implementation of the invention. Thus, phrases such as "in one embodiment" or "in an alternate embodiment" appearing herein describe various embodiments and implementations of the invention, and do not necessarily all refer to the same embodiment. However, they are also not necessarily mutually exclusive.

Descriptions of certain details and implementations follow, including a description of the figures, which may depict some or all of the embodiments described below, as well as discussing other potential embodiments or implementations of the inventive concepts presented herein. An overview of embodiments of the invention is provided below, followed by a more detailed description with reference to the drawings.

DETAILED DESCRIPTION

Devices and systems allowing training the snap or whip in arcing motions to create the explosive force sought in competitive sports. For example, the snap or whip accelerates a baseball or softball in pitching or throwing when correctly applied at the release of the ball. As other examples, the strike of a table tennis or ping-pong ball is performed with greater force and control when a snapping or whipping motion is used to strike the ball. Likewise, a snap or whip creates downward acceleration and ball control when striking a volleyball. The snap or whip can be trained according to what is described herein.

In general, a training device has a body, a sphere or holding portion, a flexible joint, and a feedback device. The feedback device can indicate whether proper motion is being practiced. If proper motion is being used, the feedback device can provide feedback to the user to reinforce proper form. With the feedback, the training device provides interactive training for developing muscle memory related to pitching, throwing, and hitting (e.g., especially for sports such as baseball, softball, and table tennis or ping pong). A generally cylindrically-shaped, weighted end is attached with a free-floating joint to a ball or holding means. The motion of throwing, pitching, or hitting with the training device provides muscle memory, while the device provides one or more forms of feedback to indicate whether proper form has been used. More details follow.

In one embodiment, the free-floating joint includes a flexible rope handle attached to the cylinder. The flexible rope handle allows the training device to self correct in windmill training because of centripetal acceleration of the circular motion of underhand pitching. A similar self correction exists for overhand rotations, including overhand throwing. The training device has a securing means, such as the flexible rope handle, to attach a wide variety of sports balls (e.g., softball-sized or baseball sized) or handles. The training device may also be applied to physical therapy (e.g., for shoulder related injuries) as well as muscle memory training.

Figure 1:
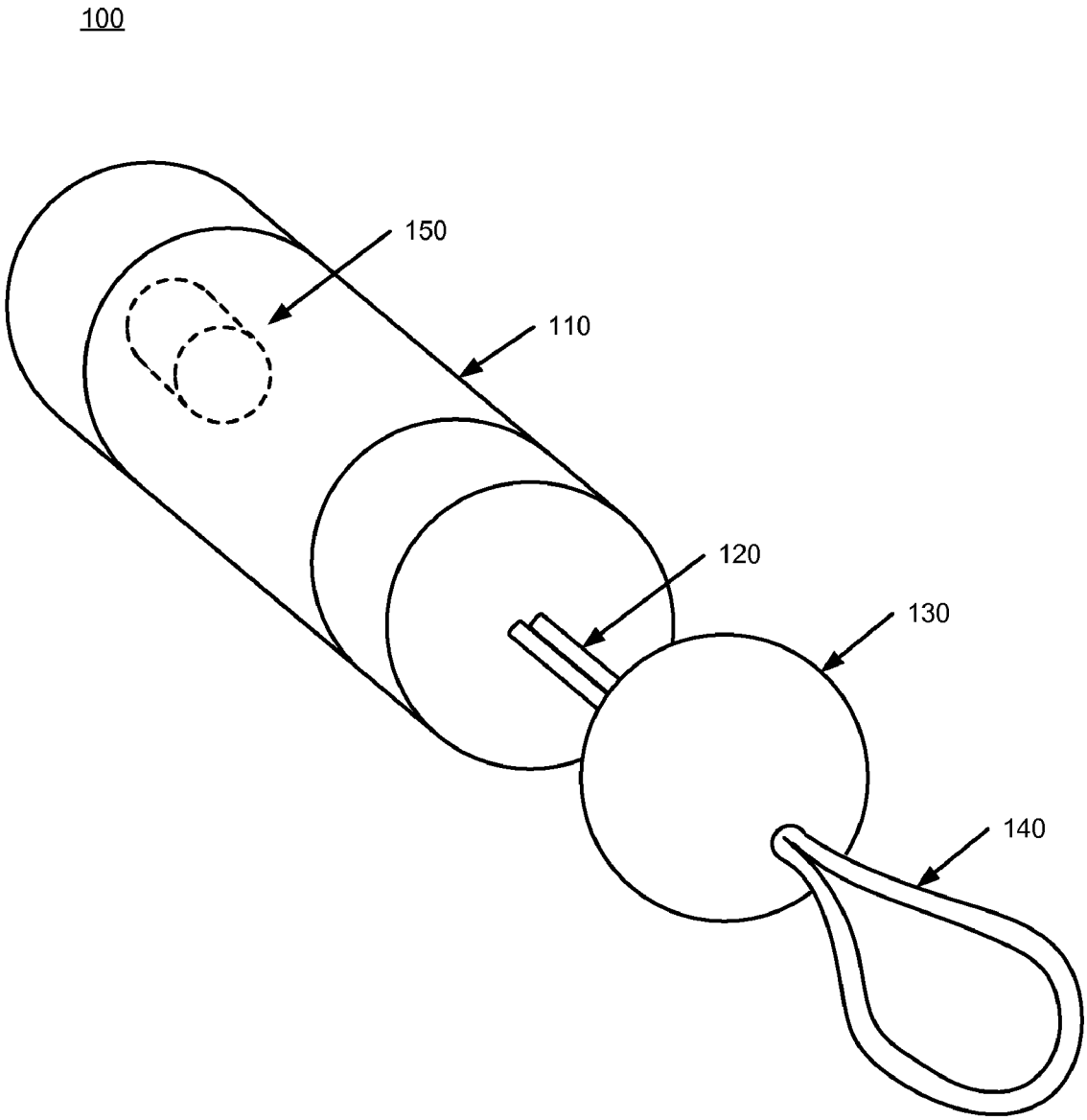
FIG. 1 is an illustration of an embodiment of a training device with a feedback device.

FIG. 1 is an illustration of an embodiment of a training device. In one embodiment, the training device is generally cylindrical in shape. Other shapes could be used, but the cylindrical nature allows for ease of manufacturing and may provide safer training due to the lack of edges that may collide with the user's body in training. However, generally brick-shape or other shapes may function in a similar way. Training device 100 includes body 110, flexible joint 120, and sphere or holding mechanism 130. Body 110 is weighted to provide the centripetal acceleration when the device is swung or moved in an arcing motion with a user grasping sphere 130. In one embodiment, sphere 130 and flexible joint 120 are made with materials that are substantially lighter than the normal weight of, for example, a baseball or softball (e.g., approximately half or less), while body 110 is weighted to extend the force of the arcing motion out beyond the user's hand. The unique combination of the flexible handle and end mounted weight allow correct self-alignment of the pitching or throwing arm plane, which results in throwing mechanics with improved form. The improved form leads directly to correct muscle memory and increased ball speed.

Training device 100 is specifically usable for either overhand throwing training or underhand pitching training. The length of body 110 is designed to train either motion. Training device 100 has a soft outer shell with a lightly weighted end to require the user to fully extend flexible joint 120. Without full extension, the training device does not arc correctly, and the device will collide with the user. The length of body 110 (the cylinder) allows the cylinder to swing in a pendulum-like motion forward and cause the user to snap the throwing hand forward at the wrist. The hand leads sphere 130 forward, with the body trailing until the point of snap. When executed correctly, the snapping motion at the wrist causes the training device to swing clear of the user. When the snapping motion is performed incorrectly, the training device generally strikes the user's hand or arm. The feedback occurs similarly for failure to snap in the underhand motion. Thus, getting hit in any fashion provides negative feedback to the user, while positive feedback is provided when the training device does not strike the user. The feedback will encourage the user to snap more vigorously through the throw, which is the proper mechanics of the throw.

In one embodiment, training device 100 also includes securing device 140. Securing device can be or include a rope or a strap or other mechanism to loop or secure around a user's wrist. Securing device 140 could be as simple as a rope or strap that is an extension of a rope or strap used to create flex joint 120. In one embodiment, the extension can pass through the middle of sphere 130, allowing the flex joint to be adjustable in length. While not shown, securing device 140 could include a strip of cloth or leather or other natural or synthetic material on the loop end. Such a strip could act to pad the loop around the user's wrist and/or create additional securing friction.

Training device 100 includes one or more feedback mechanisms 150. In one embodiment, feedback mechanism 150 includes a mechanical or electronic torque sensor. An example of a mechanical torque sensor design is provided below with respect to FIGS. 2A and 2B. In either a mechanical or electronic design, as an example, a pressure transducer can be actuated by a weight. A mechanical response can be activated by centrifugal force on the weight, causing a whistling noise. It will be understood that as used herein, "centrifugal force" refers more specifically to reactive centrifugal force, which exerts a force opposite to the centripetal force on body 110 and flex joint 120. The centripetal force acts down from the training device towards the hand of the grasping user rotating the device. The centripetal force keeps the device moving in an arc. The centrifugal force (reactive centrifugal force) refers to the pull on flex joint 120 and the ball or holding device (sphere 130) by body 110. The centrifugal force tends to pull the end of body 110 outward, away from the user when the training device is caused to be in an arcing motion.

In one embodiment, the transducer is connected to electronic circuit(s) that determines the amount of pressure (e.g., ft-lbs) applied on the transducer. The pressure can be monitored (e.g., sampled by the electronics) to determine a change, and thus determine an acceleration of the training device. The acceleration or torque applied to the device can indicate whether appropriate wrist snap action was applied by the user. The electronics can include a digital readout (e.g., an LCD display) and/or sound. The sound can be different tones generated based on performance, or can be a digitally-produced voice announcing a performance metric (e.g., ball speed, acceleration, pressure, or anything else that can be calculated or deduced from the transducer monitoring). Similar mechanisms can function to vary the audio produced by a mechanical torque feedback.

Thus, in one embodiment, the training device provides a numerical readout that gives derived ft-lbs readings that can be translated into calculated ball speed. The device can also store results, which allows the training device to indicate best performances, performance increases, etc.

In one embodiment, the training device includes an audible feedback mechanism that responds to increased torque. The audible feedback can include increased loudness and/or higher frequency that increases with increased torque. The torque is generated by wrist snap, and thus, the audible feedback can indicate good and better wrist snap mechanics. If the sound quickly accelerates at a point in the throw, the user can have greater confidence that wrist snap has occurred. With feedback device 150 to make the training device responsive to acceleration through the arc (torque), the training device can provide useful feedback to indicate performance.

In addition to use with overhand throwing, the training device can be applied to provide the same type of feedback for table tennis swing practice. The forehand and backhand swinging motions have significantly more impact in table tennis when performed with good wrist snap. Rather than using the training device in an overhand throwing motion, the training device could be held around the user's midsection and swung in a hitting motion, or swung in a back-and-forth motion simulating both forehand and backhand swings. Similar audio and/or visual feedback can provide the user with information indicating the performance of the user.

Additional variations on the training device may include an alternative mechanical torque indicator. For example, a telescoping extension can be provided in body 110, which is forced to telescope out of the cylinder based on the motion of the throw. The telescoping mechanism can be implemented with resistance built into the mechanism to prevent "maxing" out the telescoping mechanism without applying what would be generally considered to be the proper amount of acceleration.

Training device 100 allows teaching correct snapping or whipping motion for either overhand or underhand throwing or arcing motions. While visual feedback such as providing a torque or estimated speed readout is useful, audio feedback can provide preferred interactive positive reinforcement of correct motion and negative reinforcement of improper motion. When swung in a circle, training device 100 allows a user to spin 60-100 times/rotations per minute. If every rotation can be performed with audio feedback that allows a user to know whether proper form is being used while still being able to swing roughly an arc per second, muscle memory is developed more quickly. Visual feedback may be convenient for some information, but does not match the interaction of audio feedback for continuous muscle memory development. The flex joint (120), appropriate length of the body cylinder or tube, and strategically weighted head, keep the device tracking in the correct motion to most effectively complete the motion of the throw, whether overhand throwing or windmill pitching.

The audio feedback allows a user or trainer to monitor both the snap quality and the snap point. It can be said that the audio feedback indicates where in the arc or when in the rotation the snap occurs, and may indicate how effective the snap is. For example, the audio feedback can have louder and shorter durations indicating how effective the snap was. Such a response is responsive to the amount of force or torque applied by the user to the sphere, and thus to body 110 of training device 100 itself. The more force applied, the greater the break over or acceleration of the training device through the arc, as indicated by a change in audio feedback. Additionally, the snap point is indicated generally based on when a change in audio response occurs. In one embodiment, audio is produced on every rotation, and an increase in force due to increasing acceleration of the training device changes the audio response. Where the change occurs can indicate the area in the arc of the snap point, which corresponds to the proper release point or release area for a throw. In one embodiment, higher pitch corresponds to increased acceleration, which means an increase in pitch corresponds to an increase in acceleration. The more intensely the pitch changes or the louder the sound gets, can correspond to the increase in acceleration, indicating greater torque corresponding to better snap mechanics.

It will be understood that training device 100 improves training by reinforcing proper form, discouraging improper form, and providing interactive feedback to the user. Additionally, training device 100 allows training indoors or outside. The user can simulate a ball in hand with sphere 130, and complete a throwing motion with the ball. The user can practice the complete motion in an area as small as 4-foot by 8-foot. Average height users may not even need a ceiling higher than the standard 8-feet, while taller users may require additional overhead area for proper form.

To reiterate, when either pitching the windmill or throwing a ball overhand, there is a common movement that propels the ball in the thrower's hand to reach its peak speed explosion immediately prior to release. The movement increases pressure on the ball until release. Until now, there has not been a way to effectively monitor such pressure on the ball as it travels through the motion while in the thrower's hand. A speed gun provides the user with the ultimate speed result, after release. However, it cannot indicate how effectively the snap motion is carried out, and thus fails to indicate whether a thrower can improve performance.

To maximize each individual's potential, the snap or release should be maximized. The audio feedback on the throwing motion indicates to the user and/or coach whether the ball is reaching its maximum explosion speed by with an audible response that corresponds to the increase in force applied to the training device, which is caused by increased pressure on the ball. In one embodiment, sound or noise generated by the training device increases as the device breaks through the snapping point; and, the more pressure placed on the head of the device, the louder the audio gets. It will also be understood that the flex joint allows the snapping motion to be performed to provide the feedback.

The user forces the sphere or holding device (a ball) through the arcing motion, simulating the throw. The training device is connected at a fixed point to the sphere via the flexible joint. When the ball travels through the pitching or throwing motion, the flex joint tightens, allowing the body 110 of the training device to travel behind the user-thrower's hand. When the user applies torque to the sphere to simulate the snapping motion of a throw, the fixed point accelerates, pulling on the flex joint, which applies increased force on the training device, accelerating the body through its arcing movement. The flex joint allows the body of the training device tube to break over ahead of the hand, which causes the release or snap motion to intensify. The ball leads the hand, and the body of the training device follows the hand, due to centripetal force. The action forces the finish of the pitch or throw.

The user can and should use the device for warm-ups. The device forces the motion to take place properly. The user quickly loosens up the throwing/pitching arm and shoulder. The end result of the warm-up is that the stretching portion of the warm-ups takes place in a much shorter time span with fewer motions. The reduced time in warm-ups and stretching can change the strategy for coaches. Pitching rotations can be made on a much shorter notice. Because the training device encourages the proper motion for both overhand throwing and windmill pitching, it becomes a correcting tool when needed. The user can use the device to correct pitching or throwing mechanics between innings.

As mentioned above, because the training device is designed with flexible connections, it magnifies mistakes or improper mechanics. For example, if the user were pitching windmill, the training device as an extension over the user's head would indicate whether the user's arm circle drifted off the in-line plane (e.g., the common mistake of drifting over the user's head). The arm circle is indicated more clearly, which allows monitoring whether the correct arm circle plane is used.

Figure 2A:
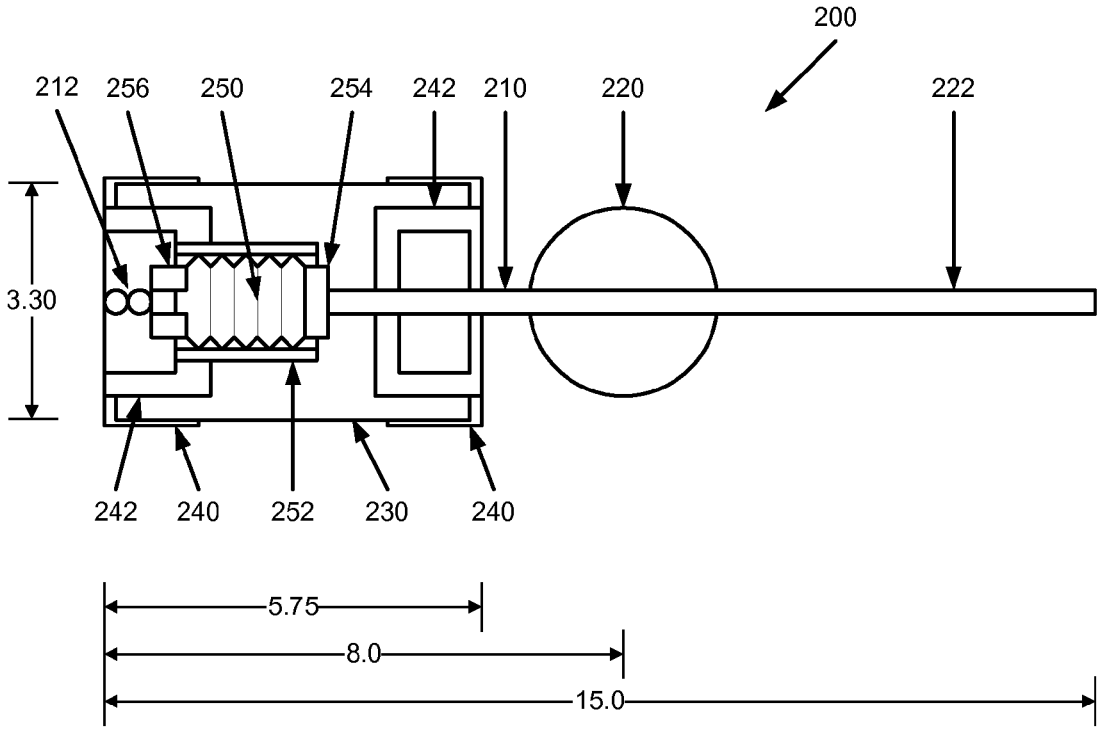
FIGS. 2A-2B illustrate embodiments of a training device with a mechanical feedback device.
Figure 2B:
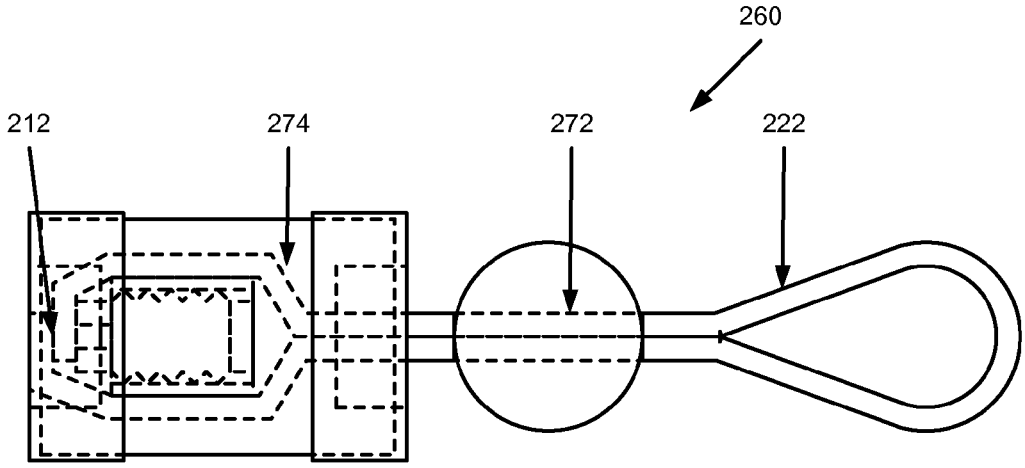

FIGS. 2A-2B illustrate embodiments of a training device with a mechanical feedback device. The training device is illustrated with view 200 in FIG. 2A of a cross-section of the training device. The training device is illustrated with view 260 in FIG. 2B showing a view onto a training device that illustrates an embodiment of the flex joint and securing device. It will be appreciated that the examples of measurements are simply examples of one implementation, and other measurements could be used. It will be understood that although certain example measurements are shown, the components illustrated are not necessarily drawn to scale.

With reference to FIG. 2A, the training device includes flex joint 210, which connects body 230 to sphere 220. Flex joint 210 (also referred to as a flexible joint), flexibly connects the spherical portion and the cylindrical portion of the training device. The flexible connection allows movement of the cylindrical body portion (230) at any rotational angle relative to the spherical portion (220). The length of the body connected to the flex joint allows the training device to provide a break over in response to a snapping motion of the arcing motion of use of the training device. The break over occurs when the body accelerates ahead of the sphere on the arc due to the snapping motion. The length of the body affects how soon or how late the break over occurs in response to a snapping motion. The break over is effected by the centripetal acceleration due to the snapping motion. The body may follow the sphere until the snapping motion causes acceleration of the body with respect to the sphere, causing the body to overtake the sphere along the arc. After the body breaks over the sphere, the flex joint will slack. Such a flex joint 210 can be achieved, for example, with rope, string, leather, or other threaded substance. The substance selected should be substantially rigid, rather than capable of stretching, given the stretching out of the flex joint would not allow the motion of the arc and snap to be generated as described herein. Thus, rubber or synthetic substances that have a substantial amount of stretch when force is applies are less desirable. The length of flex joint 210 is nominally 0.75 inches, and may be anywhere in the range of approximately 0.5 to 2 inches.

In one embodiment, flex joint 210 is hooked through body 230, and through a light weight ball for sphere 220. In one embodiment, the rope or strap of flex joint 210 may be extended out through sphere 220, providing a loop through which the pitching hand is inserted. The loop acts as a securing device, illustrated by 222 in FIGS. 2A and 2B. The securing strap becomes a safety loop that allows a user to train at any level of intensity with minimal risk the training device will be launched out of control.

Sphere 220 is a holding device, or a device to which the user can grasp to perform the throwing or swinging motion. In one embodiment, sphere 220 is similar in shape and size to a baseball or a softball. The sphere could also approximate the weight of a softball or baseball. However, keeping sphere 220 lighter than the actual ball allows putting weight in the body without overstressing the user's joints during the throwing motion. In one embodiment, the diameter of the sphere is nominally the diameter of the body, and may be any comfortable size from approximately 2 inches to 5 inches.

Body 230 includes multiple components, which are described in turn. In one embodiment, body 230 is a cylinder, having a non-rigid exterior. The non-rigid exterior is a substance that prevents the cylinder from being hard enough to injure the user. While negative reinforcement for improper form can encourage proper form, it may not be advantageous to injure the user to create negative reinforcement. Thus, wood, metal, ceramics, or rigid plastics or other materials that have little to no surface give would likely not be appropriate materials. Combinations of foam, fabrics, softer plastics, or similar substances are better choices. It will be understood that certain designs could use more rigid materials for certain parts of the body, which would then be covered by a softer material for best results.

While there is not necessarily a length-to-diameter ratio for body 230, a ratio close to 1.75-to-1 or 2-to-1 achieves a good result. Most designs would generally have ratio of greater than 1-to-1 for length-to-diameter. In one embodiment, body 230 has a length between approximately 3.5 to 9 inches, such as approximately 5.75 inches. In one embodiment, body 230 has a diameter between approximately 1.5 to 5 inches, such as approximately 3.3 inches. The length and the general sizing of body 230 can affect the usability of the training device. If the length is not long enough, it may cease to be effective in monitoring the pitching plane. If the length is too long, the breaking action of the snapping motion will not properly simulate the sports motion (e.g., throwing). If body 230 is too long, the break-over/snap occurs too late to assist the user in creating the snap/whip at the correct point or area or angle in the swing arc.

Additionally, the weight of the body can have a significant effect on use of the training device. Body 230 is weighted to provide a centripetal force along a length-wise axis of the cylindrical body portion during a pitching or throwing motion or other swinging of the training device. In one embodiment, the weight of body 230 is between approximately 9 ounces to 13 ounces, such as approximately 11.5 ounces. Without enough weight, the training device may fail to produce sufficient force to encourage proper form. With too much weight, the training device could injure the user. In one embodiment, additional weight, even beyond 13 ounces may be used, such as for muscle buildup and training. The weight may be adjustable, such as by removable/insertable pellets, rings, tabs, water, or other known mechanisms. In one embodiment, such additional weight may be in addition to a fixed weight that applies the torque response. With total training device weights of under two pounds, the training device provides an excellent tool for use at high speeds for throwing training, and at low speeds for rehabilitation of shoulder or arm injury.

Body 230 includes a core, which may be entirely made of a soft material as described above. The core may be capped by end caps that include a capping portion 240, and an insert portion 242. Capping portion 240 may be considered an alignment cap that is inserted into the body core. Portions 240 and 242 may be a single unit. In one embodiment, a feedback mechanism is attached or connected externally to body 230. In one embodiment, as illustrated, a feedback mechanism is embedded within body 230.

Different feedback mechanisms could be used. For example, a laser light generator (such as a device similar to a laser light pen) could be included to provide a visual feedback mechanism that indicates the rotation plane. Audio feedback mechanisms can be included that are responsive to the torque created in the arcing motion. As mentioned above, such a device may include an electronic circuit including an accelerometer and digital output devices. In one embodiment, as illustrated, a mechanical audio feedback mechanism can be used. The audio feedback device is embedded within, or otherwise connected to body 230. In one embodiment, the audio feedback device generates a variable audible response to the snapping motion of the arcing motion. The variable audible response may include differences in tone, pitch, and/or loudness or intensity. For example, in one embodiment, the audible feedback indicates when in the arcing motion the snapping occurs based on an intensity of the sound. In one embodiment, the audible feedback indicates an increase in torque on the spherical portion exerted due to the snapping motion based on a change of pitch or tone.

In one embodiment, the audio unit activates at low levels of torque. Thus, the audible feedback can operate at low spin levels (low rotations per minute) as well as higher spin levels (higher rotations per minute) at the release point. The user hears the audio level change as he or she enter different phases of the pitch or throw.

As illustrated, the audio device or audio feedback device includes a tube or casing 252, such as a PVC pipe or plastic housing. Other materials could be used, but should be monitored for the effect on weight—thus, wood or metal could be used but would increase the weight to a point that may be undesirable. In one embodiment, housing 252 includes bellows 250, which responds or depresses when centrifugal force is applied by weight 254. Thus, weight 254 may be referred to as a depression weight. The bellows can cause a whistling noise in noise maker 256, where the pitch is controlled by the depression of the bellows, as caused by increasing force applied by weight 254 due to the force caused by the arcing.

Referring more particularly to FIG. 2B, view 260 illustrates an implementation where flexible joint 210 includes a strap or rope that forms a loop in 222. The separate strands of the strap that form the loop can pass through sphere 220, as shown at 272. In one embodiment, sphere 220 has a hole through a diameter through which the strap passes. Thus, the sphere may be moved closer or farter from body 230, but still have a fixed pivot point, being the hole through which the flexible joint extends to the body of the training device. The two ends of the strap in view 260 can be wrapped on either side of the audio feedback device and bonded at 212. A cross-sectional view of the bonded straps is illustrated for purposes of reference in FIG. 2A.

In addition to adding and/or removing weight to adjust the weight of the training device, in one embodiment, depression weight 254 may be removable or otherwise adjustable to adjust the audio response of the audio device. Alternatively or additionally, the compression factor of bellows 250 or a different compression device may be adjustable, such as by the inserting of a spring or tensioning rod. In one embodiment, a spring or tension rod may be used, such as with an electronic sensor implementation. Adjusting the sensitivity of the response can help adjust the training device for different ages, for example. Thus, those expected to have greater strength and skill can increase the torque requirement needed in the snap motion to achieve a particular audio response, and those with less strength can decrease the requirement.

It will be noted that certain example measurements are provided, indicating an example size for one embodiment of the training device. In addition to the 3.3 inch diameter of the body, and the 5.75 inch length, measurements are shown to indicate approximately 8 inches from the end of the body to the center of the holding device (sphere 220), and 15 inches from the end of the body to the end of the securing strap.

Figure 3:
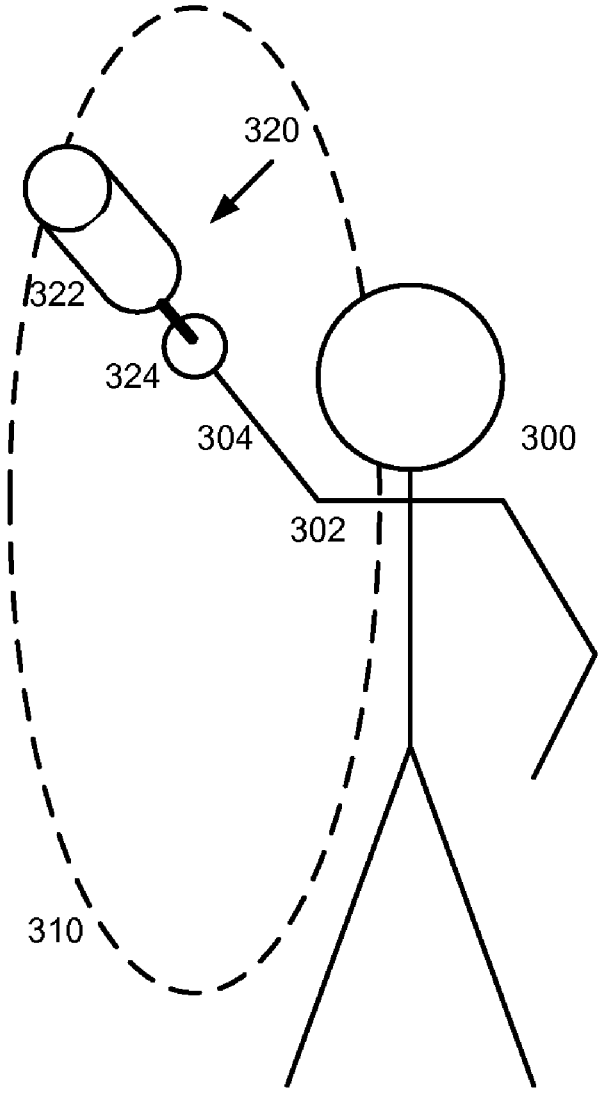
FIG. 3 is an illustration of an embodiment of operation of a training device.

FIG. 3 is an illustration of an embodiment of operation of a training device. User 300 is shown generically with training device 320. Training device 320 may be either used for underhand pitching training, or overhand throwing training. User 300 should generate a good motion at shoulder 302 with arm 304. Training device 320 includes ball or handle 324 where user 300 holds the device, and cylinder portion 322 that may include the feedback mechanisms described above. When used for underhand pitching training, training device 320 is intended to be swung in a consistent plane 310. As described below with respect to an example system described in FIGS. 4A and 4B, the user can attempt to line plane 310 with targets that reflect and/or detect laser output from training device 320. When used for overhand pitching training, the motion will be more elliptical rather than a full circle, and may be only an arc in plane 310 rather than a full circular motion, when practicing throwing. Warming up may utilize the full plane, just in the opposite direction as for windmill training.

With reference to the device as illustrated in FIG. 2A, the operation of training device 320 may be described as follows. User 300 may insert a hand through rope handle (222) and grip the ball or handle (220) in the same manner as during a sporting event. As the training device is moved in the desired way (e.g., rotating in a circular motion, swinging, etc.), the flexible rope handle is automatically tightened to the hand insuring that the training device will not come off. The rotation of the training device pulls the arm, by centripetal acceleration of end mounted weight in the training device body (230), to the maximum radial position of the arm, which has been found to be the optimum pitching and throwing plane. The device may be rotated in an overhand motion to stimulate the arm action of sports such as baseball, tennis, and volleyball and it may be rotated in an underhand motion to simulate the arm action of softball pitchers. The training device self corrects to the optimum rotation plane in either direction.

The training device allows beginners to learn the correct throwing mechanics and to build correct muscle memory from the start, instead of developing bad habits. Individuals who have not had proper training and have developed severe deficiencies in proper mechanics can be retrained with the training device. Old bad habits can be replaced with correct throwing mechanics and the incorrect muscle memory can be relearned. The training device also allows advanced users to eliminate imperfections in the throwing plane, which results in better accuracy and greater speed. Improper throwing mechanics increase stress to the body, which can result in minor to sever injury and loss of playing time. Sports related throwing injuries can be reduced or eliminated by learning proper throwing mechanics. The training device improves and corrects proper throwing mechanics and thereby reduces the risk of injury.

The training device is not limited to sports training. The training device may also provide benefits as a physical therapy tool for shoulder related injuries. Use of the training device can reduce stress and increase flexibility and endurance of the shoulder's ball and socket joint, which aids in the recovery of shoulder related injuries.

Figure 4A:
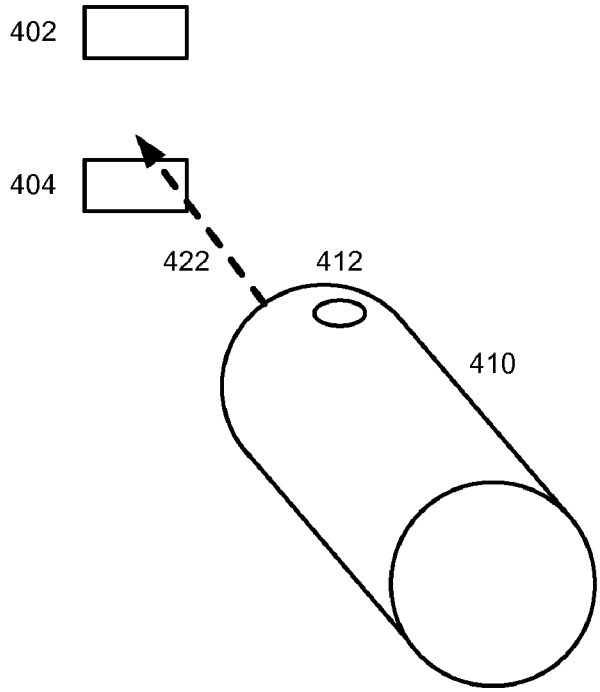
FIGS. 4A-4B are block diagrams of embodiments of an underhand pitching training system.
Figure 4B:
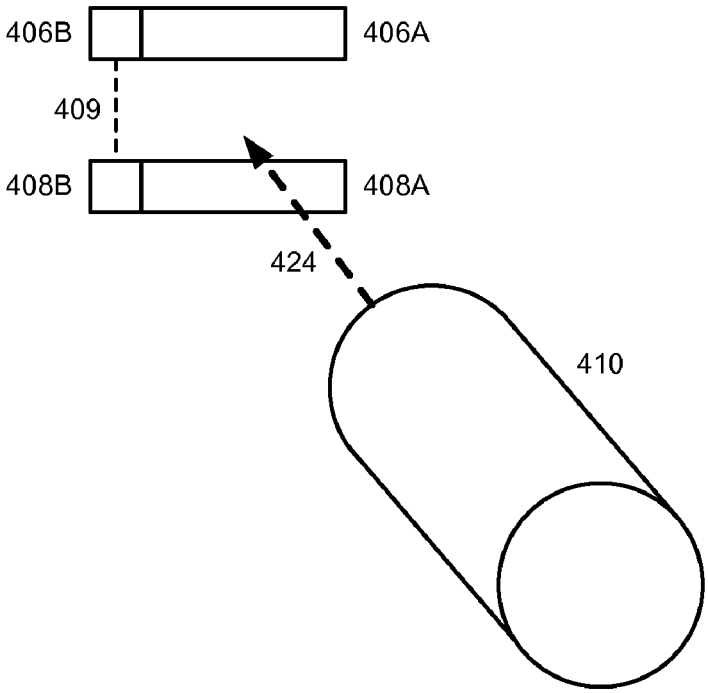

FIGS. 4A-4B are block diagrams of embodiments of an underhand pitching training system. The feedback mechanism (150) as illustrated in FIG. 1 may include a laser light pen inserted inside the end cap of the training device. A simple spring switch in the end could allow the user to apply pressure to the end cap to turn the laser on or off. Other laser device could be employed, and switches could be provided on the outside of the device. Additionally, an on-off mechanism could be employed to allow turning the laser on or off via screwing or twisting the end cap.

FIG. 4A illustrates training device 410 that is outfitted with a laser. In practice, laser light 422 is emitted from training device 410 when operational. Thus, a user may turn on the laser, and begin to swing training device 410. The user can then self-monitor, rather than requiring another person to provide monitoring and feedback. The laser-enabled training device 410 can be used in front of a wall or other surface that allows the user to see when the light passes up the wall.

To further ensure a correct rotational plane, targets 402 and/or 404 can be mounted on the wall or other surface. Note that if a single target, 402 or 404, is used, the user may still spin training device 410 incorrectly. For example, the user may spin with a rotational plane that goes over the head, or off to the side instead of in line with the strike zone. When two targets 402 and 404 are correctly aligned on the wall, the laser light crossing both targets in a single rotation will indicate a better rotational plane. In one embodiment, targets 402 and 404 are reflective, allowing for easy detection of the laser crossing the targets. The user can perform the spinning motion and detect whether the plane of the spin is in line with the targets, or whether the user is making the wrist turn improperly. In addition, the interactive visual feedback gives a better interaction with the training, which can help motivate the user. The targets also allow a focus point for the user to improve concentration and increase effectiveness of the training.

The user can focus on spinning through targets 402 and 404 and count the number of times the targets are both successfully crossed. The user can then determine the number of hits per minute. In other embodiments, such as shown in FIG. 4B, the reflectors may be electronically enabled to allow a system that will count for the user, and could provide a readout (not shown) that could include strikes per minute, length of time of training, efficiency percentage, etc.

In one embodiment, training device 410 includes audible feedback device 412. Audible feedback device 412 can be any of a number of mechanisms. Training device 410 could include electronics inside that detect the speed of rotation of the training device and generates a sound, such as mechanical (an example is provided above) or piezo-electric devices. Increased speed could be associated with a higher-pitch, allowing the user to detect increases and decreases in speed. Additionally, electronics could detect variations in speed, and indicate inconsistency if the speed varies too quickly. Varying of speed quickly could indicate a weakness in one area of the rotation that causes the user to slow down the spin. Audible feedback device 412 could be a simple mechanical device, such as a plastic or metal device that interacts with air flow and/or motion. Thus, increased air flow could correspond to a different tone.

FIG. 4B is similar to FIG. 4B, but illustrates a different light-interaction system. Training device 410 emits light signal 424, which may be laser light or infrared (IR) light. Rather than passive targets, FIG. 4B shows active components as the targets. Targets 406 and 408 include sensor sections 406A and 408A, and indicators 406B and 408B, respectively. Sensors 406A and 408A detect when light 424 crosses the sensors. The sensor may send a signal to indicators 406B and 408B to cause the indicators, for example, to flash. That is, a correct spin with proper plane alignment will cross sensor 408A (in underhand pitching), which will cause indicator 408B to flash or emit a sound. The spin will then cause light 424 to cross sensor 406A, which causes indicator 406B to similarly flash or emit a sound.

In one embodiment, targets 406 and 408 are coupled, as shown by connection 409. Thus, the targets could include electronics to allow the indicators to provide feedback in a coordinated way. For example, each indicator may flash when its respective sensor is crossed, and if the system detects that both sensors were crossed in series, a sound could be produced. Additionally, a display (not shown) could be provided to indicate a count of the number of correct spins, a number of correct consecutive spins, a spin speed (e.g., deduced by how quickly the two targets are crossed in series), or other information.

Additionally, the two sensors could coordinate timing of the crossing of the sensors to indicate a rotational speed of the swing. Such a rotational speed could be used to determine a speed of a spin, an approximate torque on the ball, or an estimated throwing speed. Processing electronics, such as a simple programmed microcontroller, could perform computations to determine the estimated speed or torque and provide a readout in an indicator (either 406B or 408B, or another indicator not shown).

Figure 5:
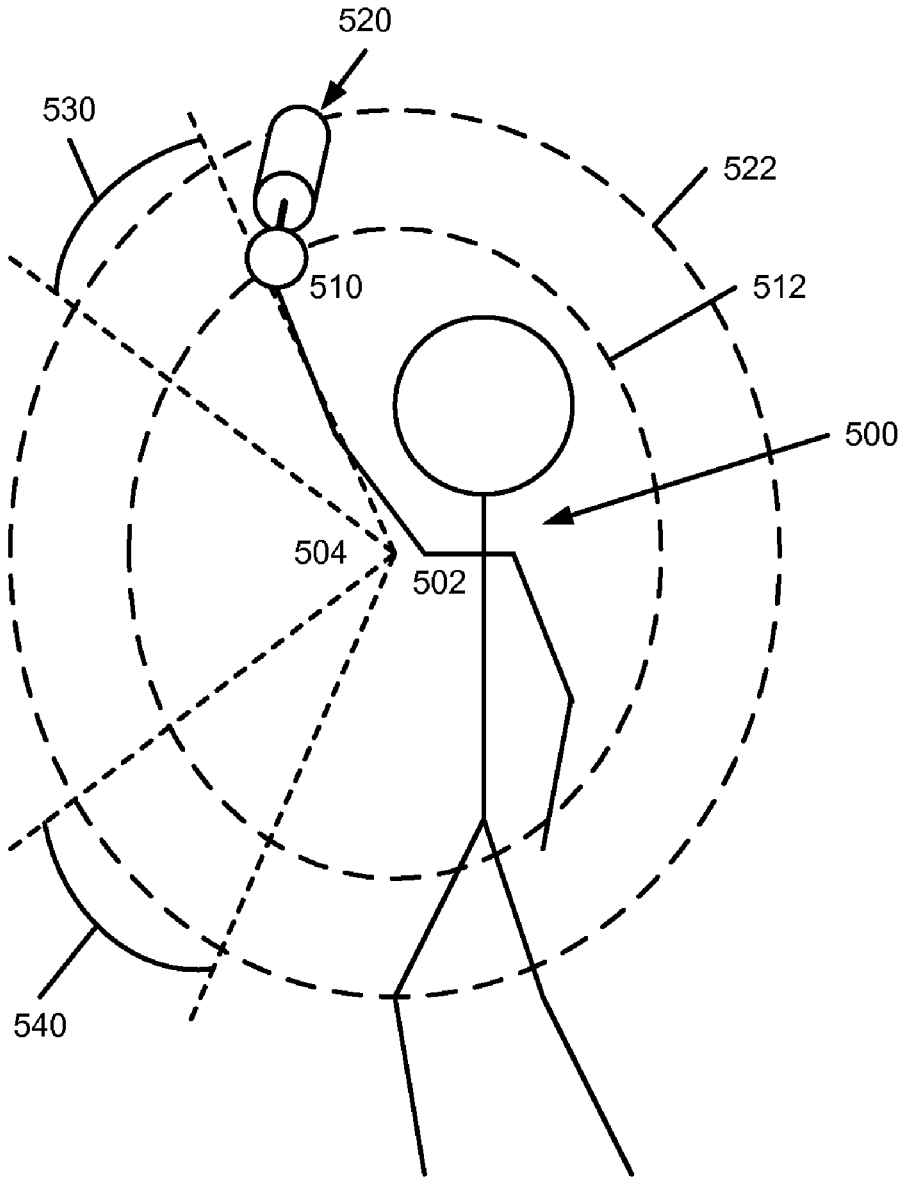
FIG. 5 is an illustration of an embodiment of feedback target areas for operation of a training device.

FIG. 5 is an illustration of an embodiment of feedback target areas for operation of a training device. FIG. 5 illustrates a target release area, or a target snap area within the arc. User 500 rotates training device 520, leading the ball with hand 510 ahead of the training device in its arc. The arc of the ball and the arm as would normally occur in a throwing motion is illustrated by circle or arc 512. The arc of a center of mass of training device 520 is illustrated by circle or arc 522. The arc of the training device follows the arc of the hand, but is extended from where the hand moves. The extension of the arc with a larger arc induced by the training device weight provides a tension, drag, or resistance on the throwing motion. The tension or resistance causes the user to work to produce proper form in the movement. It will be understood that overhand throwing practice with device 520 may result in more of an elliptical arc, and may not be a complete 360 degree motion.

Considering the user's shoulder 502 to be the center or pivot point 504 of the arc (whether circular or elliptical), there is a preferred release area for throwing and for underhand pitching. The overhand release area is approximated by angle 530, while the underhand release area is approximated by angle 540. It will be understood that the areas are meant as general, approximate indications of the release principle, rather than as precise areas that may be derivable from measuring the angles illustrated. Assuming training device 520 is equipped with an audio feedback device, a user or a trainer/coach could listen for a snap response within the desired area (530 or 540). The snap response can be indicated by a change in audio response, as discussed above.

Besides what is described herein, various modifications may be made to the disclosed embodiments and implementations of the invention without departing from their scope. Therefore, the illustrations and examples herein should be construed in an illustrative, and not a restrictive sense. The scope of the invention should be measured solely by reference to the claims that follow.

What is claimed is:

1. An apparatus comprising:

a spherical portion;

a cylindrical body portion, the cylindrical body portion having a non-rigid exterior, the cylindrical body portion having a weight to provide a reactive centrifugal force along a length-wise axis of the cylindrical body portion during an arcing motion;

a flexible joint connected to the spherical portion and to the cylindrical body portion, the flexible joint flexibly connecting the spherical portion and the cylindrical portion to allow movement of the cylindrical body portion at any rotational angle relative to the spherical portion, the cylindrical body having a length to cause the joint to create a break-over in response to a snapping motion of the arcing motion; and an audio feedback device connected to the cylindrical body portion to generate a variable audible response to the snapping motion, the variable audible response having an intensity that indicates when in the arcing motion the snapping occurs, and indicates an increase in torque on the spherical portion exerted due to the snapping motion.

2. The apparatus of claim 1, wherein the arcing motion comprises a pitching or throwing motion.

3. The apparatus of claim 1, wherein the spherical portion comprises an object having a size and shape of either a baseball or a softball.

4. The apparatus of claim 1, wherein the spherical portion has a diameter of between approximately 2 to 4 inches.

5. The apparatus of claim 1, wherein the cylindrical body portion has a length of between approximately 3.5 to 9 inches.

6. The apparatus of claim 1, wherein the cylindrical body portion has a diameter of between approximately 1.5 to 5 inches.

7. The apparatus of claim 1, wherein the weight of the cylindrical body portion is between approximately 9 ounces to 13 ounces.

8. The apparatus of claim 1, wherein the non-rigid exterior of the cylindrical body portion includes foam.

9. The apparatus of claim 1, wherein the flexible joint comprises a rope.

10. The apparatus of claim 1, wherein the length of the flexible joint is between approximately 0.5 to 2 inches.

11. The apparatus of claim 1, wherein the audio feedback device includes a bellows activated by a depression weight.

12. The apparatus of claim 1, wherein the audio feedback device includes an electronic circuit including an accelerometer.

13. The apparatus of claim 1, further comprising:

a securing portion connected to the spherical portion to secure the apparatus around a wrist of a user of the apparatus.

14. The apparatus of claim 13, wherein the securing portion is an extension of the flexible joint.

* * * * *